United States Patent [19]

Otto et al.

[11] Patent Number: 4,645,448

[45] Date of Patent: Feb. 24, 1987

[54] LASER EFFECTS SIMULATOR

[75] Inventors: William F. Otto; Thomas G. Roberts; Andrew H. Jenkins, all of Huntsville; Thomas E. Honeycutt, Somerville, all of Ala.

[73] Assignee: The United States of America as represented by the Secretary of the Army, Washington, D.C.

[21] Appl. No.: 808,967

[22] Filed: Dec. 16, 1985

[51] Int. Cl.[4] ..... F23C 11/04

[52] U.S. Cl. ..... 431/1; 431/158; 431/12; 431/243; 431/354; 60/39.76; 239/414

[58] Field of Search ..... 431/158, 354, 352, 11, 431/12, 243, 258; 60/39.78, 39.76, 39.81; 239/414

[56] References Cited

U.S. PATENT DOCUMENTS

| | | | |
|---|---|---|---|
| 2,523,012 | 9/1950 | Goddard | 60/39.76 X |
| 2,546,967 | 4/1951 | Breault | 239/414 |
| 2,837,893 | 6/1958 | Schirmer | 431/352 X |
| 2,948,113 | 8/1960 | Miller | 60/39.81 X |
| 3,118,489 | 1/1964 | Anthes | 431/158 |
| 3,331,424 | 9/1965 | Heinrich | 239/414 X |

FOREIGN PATENT DOCUMENTS

| | | | |
|---|---|---|---|
| 1110800 | 7/1957 | Fed. Rep. of Germany | 431/1 |
| 685886 | 1/1953 | United Kingdom | 137/625.41 |

*Primary Examiner*—Margaret A. Focarino

*Attorney, Agent, or Firm*—Freddie M. Bush; James T. Deaton

[57] ABSTRACT

A laser effects simulator having inner and outer cylinders which serve as separate plenums for two gases—a fuel and an oxidizer. Each plenum contains a multiplicity of small release ports or holes. An inner cylinder serves as a combustion chamber. The inner cylinder contains two sets of small release ports or holes arranged to simultaneously match or line up with the multiplicity of ports in the two plenums. Thus, allowing both fuel and oxidizer to be admitted to the combustion chamber and become mixed. On one end of the inner cylinder is an igniter that starts the combustion process. The reaction creates a high temperature mixture which expands to a low density hot gas that simulates the results that are produced when a high energy laser beam interacts with a solid surface.

2 Claims, 3 Drawing Figures

LASER EFFECTS SIMULATOR

DEDICATORY CLAUSE

The invention described herein may be manufactured, used, and licensed by or for the Government for governmental purposes without the payment to us of any royalties thereon.

BACKGROUND OF THE INVENTION

One of the most important effects and the most often produced effect caused when a high energy laser pulse interacts with a surface is the formation of a bubble of low density hot gas. The gas is primarily heated air but it may also contain gases from material vaporized from the surface or from paint if the surface was painted. These bubbles of low density hot gases expand into or become ingested by the system or causing some change in the system's operating characteristics.

It is desirable to simulate this effect of a high energy pulsed laser without using a large expensive laser device. The simulator makes testing possible at locations where lasers are not available and, more importantly, it makes it possible to simulate the effects that would be produced by lasers with outputs much larger than existing lasers can produce. Thus, the expense of developing such large and costly facilities can be avoided until after their potential utility has been established.

A device has recently been disclosed by Otto et al, in a patent application entitled "Pulsed Gas Supply", Ser. No. 789,859, filed Oct. 21, 1985 which may be used to address the results that are obtained when bubbles of low density, but cold gas, are used to simulate this portion of the effects produced by a high energy pulsed laser. The essential part of the Otto et al device is a fast acting valve which is capable of repetitively releasing a bubble of low density gas. The device is also useful in pulsed chemical laser devices where pulses of gas for fuel and oxidizers are required on a repetitive basis. However, it is not capable of simulating the entire results of bubbles of low density hot gas that is produced when a high energy repetitively pulsed laser beam interacts with a material surface, and a need exists for such a simulator.

It is, therefore, an object of this disclosure to provide a laser effects simulator which produces bubbles of low density hot gases repetitively as a high energy repetitively pulsed laser produces.

DETAILED DESCRIPTION OF THE PREFERRED EMBODIMENT

Figure 1:
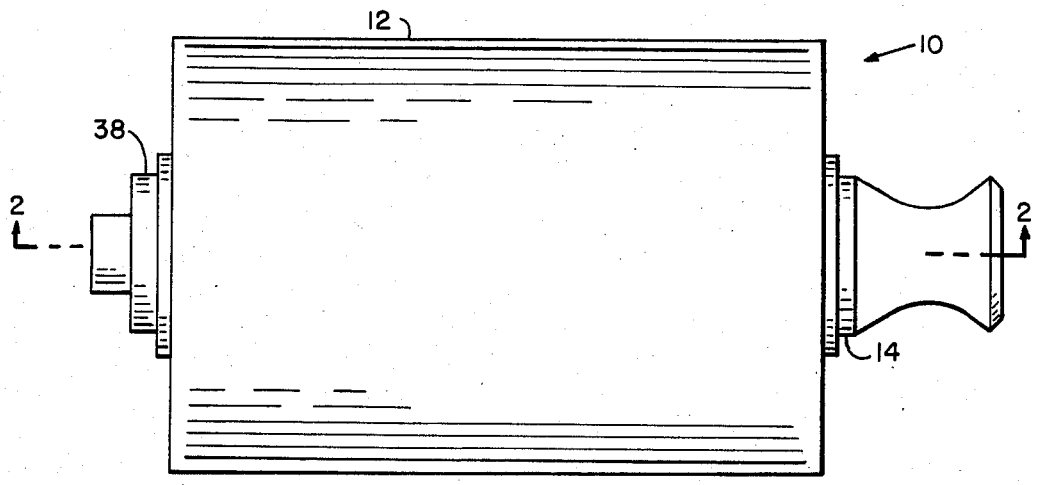
FIG. 1 is an elevational view of the laser effects simulator of the present invention.
Figure 2:
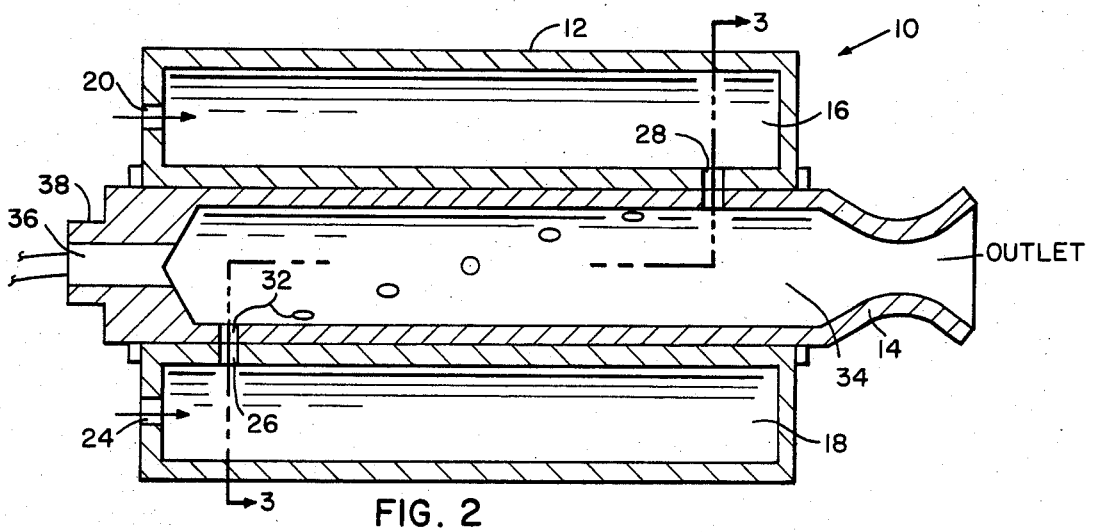
FIG. 2 is a cross-sectional view along lines 2—2 of FIG. 1.
Figure 3:
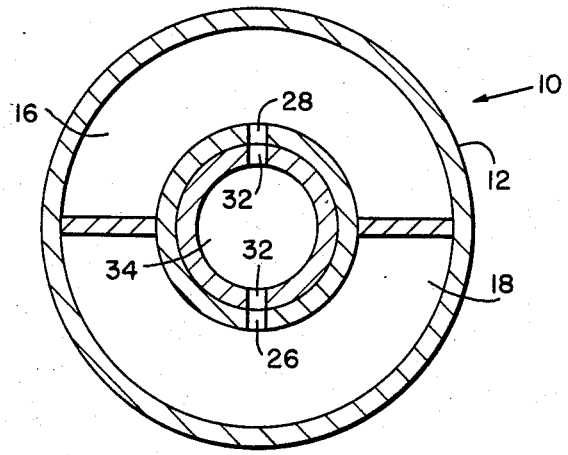
FIG. 3 is a cross-sectional view along line 3—3 of FIG. 2.

Referring to the drawings, FIG. 1 illustrates the laser effects simulator 10 of the present invention. The laser effects simulator consists of an outer cylinder 12 and an inner cylinder 14, which is made so as to contain two half-cylinder cavities 16 and 18, respectively, (FIG. 2). Each half cylinder serves as a plenum and contains gas inlet ports 20 and 24. Each half cylinder also contains a multiplicity of release ports or small holes 26 and 28. Inner cylinder 14 rotates and has a multiplicity of small holes 32. The small holes 30 and 32 are match-bored so that they all open simultaneously and they all close simultaneously. The holes are made small enough so that they open and close as quickly as desired. When the holes are open, the gases in the plenums 16 and 18 enter the combustion chamber 34 and mix. In this application, one gas is a fuel such as propane, methane, acethylene, etc., and the other gas is an oxidizer such as oxygen. A short time after the holes have closed, trapping the fuel-oxidizer mixture in the combustion chamber 34 an igniter 36, which is located in one end 38 of the inner cylinder 14, is fired. This causes the fuel-oxidizer mixture to ignite, thus producing hot gases that expand through the outlet creating a bubble of low density hot gases similar to that produced by a high energy pulsed laser. As the inner cylinder rotates, the holes again come into alignment admitting another fuel-oxidizer mixture and the process is repeated. The pulse repetition rate is determined by the rotation velocity of the inner cylinder which is adjustable. The igniter could be any device that produces a spark strong enough to cause the fuel-oxidizer mixture to react rapidly, but the particular igniter desired in this embodiment is an application of the arc plasma generator starter taught in U.S. Pat. No. 3,356,897 issued to Thomas A. Barr, Robert F. Mayo and Thomas G. Roberts on Dec. 5, 1967. This igniter is inexpensive, simple to construct and lends itself nicely to this application because it projects a fast-moving jet of hot plasma along the axis of the combustion chamber 18 which insures the proper propagation of the combustion flame in 18. The timing of events is accomplished much like that of any internal combustion engine. That is, a distributor (timer) is used. However, one of the new electronic ignition systems could be used if desired.

The design of this device takes advantage of the balanced force design taught in the Otto et al patent application. However, the pressures in chambers 16 and 18 are much lower because the energy necessary to create and expel the bubbles of low density hot gases comes from the release of chemical energy in the combustion process. Therefore, the leakage flow is minimal, and the lubricant and torqueing problems do not develop. The release of chemical energy does heat the inner cylinder and, by conduction, the outer cylinder and the rest of the device. Because of this, the device is either operated in a heat sink mode where the number of pulses that can be simulated is limited by the rise in temperature of the lubricant. In this case, one must wait until the device has cooled sufficiently before it is used again, or the device may include cooling channels in the walls of inner chamber 34 or the walls of the outer chambers 16 and 18. When inner chamber 34 is cooled, the cooling solution may enter and exit on axis around the igniter. In either case, cooling complicates the construction and increases the cost of the device and should be accomplished only when test demands warrant the additional time and expenses.

We claim:

1. A pulsed hot gas generator comprising:

a. a first cylindrical housing having a pair of half-cylinder plenum chambers defined therein by outer and inner cylindrical sections that are joined by end sections and two lengthwise radial dividers to define said pair of half-cylinder plenum chambers for receiving first and second gases therein;

b. a second cylindrical housing concentrically mounted in said first cylindrical housing for rotation therein, said second cylindrical housing having a chamber defining a combustion chamber;

c. said first and second cylindrical housings having a plurality of matched ports therein, said ports of said first and second cylindrical housings disposed for aligned relation responsive to rotation of said second cylindrical housing, whereby responsive to the aligned relation of said ports, said first and second gases are directed into said combustion chamber;

d. igniter means mounted at one end of said second cylindrical housing and in said combustion chamber for ignition of the mixture of said first and second gases; and, e. outlet means communicating into said combustion chamber to direct said first and second gases thereof responsive to the ignition, said outlet means being a nozzle at an end of said second cylindrical housing which is opposite said one end.

2. A device as in claim 1 wherein said ports are disposed around the periphery of said second cylindrical housing in a helical pattern, said ports being arranged around the peripheral surfaces of each said plenum chamber in similar helical patterns.

* * * * *